US009207702B2

(12) United States Patent
Krieger et al.

(10) Patent No.: US 9,207,702 B2
(45) Date of Patent: Dec. 8, 2015

(54) CIRCUIT BREAKER AND HANDLE LOCKING DEVICE THEREOF

(71) Applicant: Siemens Aktiengesellschaft, München (DE)

(72) Inventors: Harald Krieger, Neuhaus (DE); Qing Ping Li, Suzhou (CN); Dong Yang, Suzhou (CN); Deng Ke Zhang, Suzhou (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 101 days.

(21) Appl. No.: 14/072,039

(22) Filed: Nov. 5, 2013

(65) Prior Publication Data

US 2014/0166448 A1 Jun. 19, 2014

(30) Foreign Application Priority Data

Dec. 14, 2012 (CN) ..... 2012 1 0546023

(51) Int. Cl.
*H01H 9/28* (2006.01)
*G05G 5/00* (2006.01)

(52) U.S. Cl.
CPC ..... *G05G 5/005* (2013.01); *H01H 9/282* (2013.01); *H01H 9/286* (2013.01); *H01H 9/287* (2013.01); *Y10T 74/20666* (2015.01)

(58) Field of Classification Search
CPC ..... H01H 9/20; H01H 9/281; H01H 9/282; H01H 9/286; H01H 9/287
USPC ..... 200/43.11, 43.14, 43.15, 43.16, 43.19, 200/43.22; 403/373
See application file for complete search history.

(56) References Cited

U.S. PATENT DOCUMENTS

| | | | | |
|---|---|---|---|---|
| 5,868,242 | A | 2/1999 | Hall et al. | |
| 5,905,236 | A * | 5/1999 | Green | 200/43.14 |
| 8,720,017 | B2 * | 5/2014 | Dunn | 24/535 |
| 2013/0056336 | A1 | 3/2013 | Grül et al. | |
| 2014/0318933 | A1 * | 10/2014 | Yang et al. | 200/43.14 |

FOREIGN PATENT DOCUMENTS

WO WO 98/59352 12/1998

OTHER PUBLICATIONS

Extended Search Report for corresponding European patent application No. 13189222.6 dated Mar. 18, 2014.
Chinese patent application No. 201210546023.3 filed on Dec. 14, 2012.

* cited by examiner

*Primary Examiner* — Vanessa Girardi
(74) *Attorney, Agent, or Firm* — Harness, Dickey & Pierce, P.L.C.

(57) ABSTRACT

Disclosed is a handle locking device including a first frame, a first hook and a second frame, wherein a second hook is provided on the first frame. The first and second hooks are rotatably installed on the first frame, and the second frame capable of fixing the first hook and the first frame. Since the handle locking device is only be installable on a circuit breaker by mating between the first hook and a first installation part of the circuit breaker and mating between the second hook and a second installation part of the circuit breaker, an operator is prevented from unintentionally setting an "OFF" position of the handle locking device in an "ON" position of the circuit breaker during installation. The first hook is rotatably installed on the first frame, so that the handle locking device can be conveniently and rapidly installed on or demounted from the circuit breaker.

16 Claims, 6 Drawing Sheets

CIRCUIT BREAKER AND HANDLE LOCKING DEVICE THEREOF

PRIORITY STATEMENT

The present application hereby claims priority under 35 U.S.C. §119 to Chinese patent application number CN 201210546023.3 filed Dec. 14, 2012, the entire contents of which are hereby incorporated herein by reference.

FIELD

At least one embodiment of the present invention generally relates to the technical field of low-voltage appliances, and particularly, to a circuit breaker and/or a handle locking device thereof.

BACKGROUND

At present, the power ON/OFF function of a circuit breaker is realized by opening/closing a handle of the circuit breaker. In the process of using a circuit breaker, in order to avoid the case that the safety of an operator is under threat in power-on and power-off situations or during maintenance because of an unintended mistaken operation, causing unpredictable consequences, it is particularly important to maintain the position of the handle of the circuit breaker, so that the handle will not be operated mistakenly.

SUMMARY

An embodiment of the present application is directed to providing a handle locking device capable of preventing a mistaken operation. An embodiment of the present application is also intended to provide a circuit breaker adopting the handle locking device.

An embodiment of the present invention is directed to: a handle locking device, comprising a first frame, a first hook and a second frame, wherein a second hook is provided on the first frame; the first hook is rotatably installed on the first frame; and the second frame is rotatably installed on the first frame and is capable of fixing the first hook and the first frame.

An embodiment of the present invention also provides a circuit breaker which comprises a case and a handle installed in the case, wherein a first installation part and a second installation part are arranged on the case; the circuit breaker further comprises a handle locking device mentioned above; only by means of the mating between the first hook and the first installation part and the mating between the second hook and the second installation part can the handle locking device be installed on the case; and the handle can be locked by the second frame of the handle locking device.

The handle locking device in one embodiment of the present invention and the handle locking device in an embodiment of the circuit breaker adopting the handle locking device can be installed on the circuit breaker only by means of the mating between the first hook and the first installation part and the mating between the second hook and the second installation part, so that it can prevent an operator from unintentionally setting an "OFF" position of the handle locking device in an "ON" position of the circuit breaker during installation, and thus the safety of the operator can be guaranteed in power-on and power-off situations or during maintenance, thereby improving the safety of personnel. In addition, the first hook is rotatably installed on the first frame, so that the handle locking device can be conveniently and rapidly installed on the circuit breaker or demounted from the circuit breaker.

In order to make the technical problems to be solved, the technical solutions and beneficial effects of the present invention more apparent, the present invention will be further described in detail in conjunction with the accompanying drawings and embodiments. It should be understood that the embodiments described herein are merely for explaining the present invention, and they are not to limit the present invention.

The above description is only an overview of embodiments of the present invention. In order to understand the embodiments of the present invention more clearly so as to be able to implement same according to the contents of the description, and make the abovementioned and other objects, features and advantages of the present invention more apparent and easy to understand, detailed descriptions are made as follows with preferred embodiments in conjunction with the accompanying drawings.

BRIEF DESCRIPTION OF THE ACCOMPANYING DRAWINGS

Figure 1:
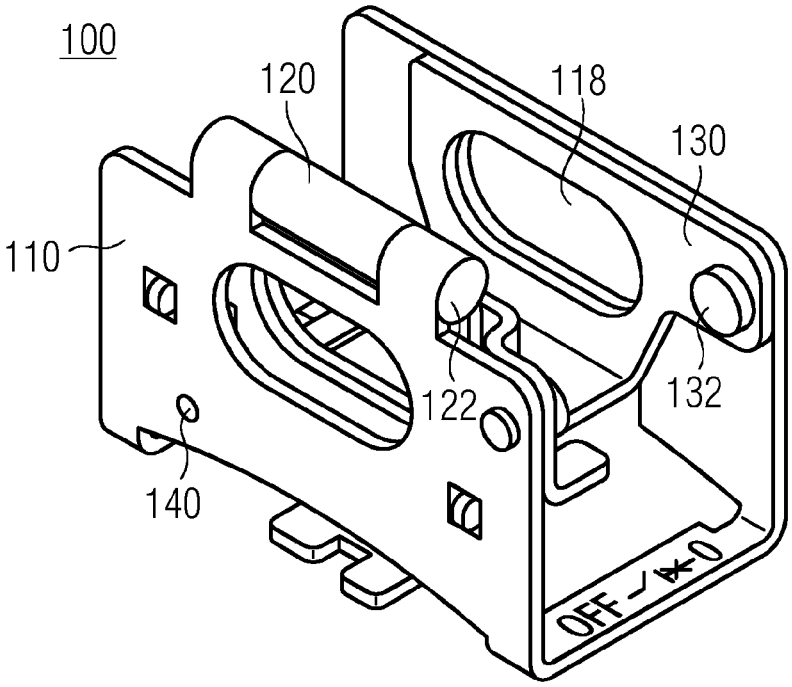
FIG. 1 is a structural schematic diagram of a handle locking device in one embodiment of the present invention.

The reference numerals are as follows:

| | | | | | |
|---|---|---|---|---|---|
| 100 | handle locking device | 110 | first frame | 112 | first beam |
| 113 | second beam | 114 | first side plate | 1142 | second hook |
| 1143 | installation hole | 115 | second side plate | 116 | fixing hole |
| 117 | installation hole | 118 | locking hole | 120 | first hook |
| 122 | pivot shaft | 123 | clamping jaw | 124 | locating structure |
| 128 | locking hole | 130 | second frame | 132 | pivot shaft |
| 133 | base plate | 134 | first side plate | 135 | second side plate |
| 136 | connection part | 138 | locking hole | 182 | first male tab |
| 184 | second male tab | 200 | circuit breaker | 210 | case |
| 212 | first installation hole | 214 | second installation hole | 218a | first installation part |
| 218b | second installation part | 220 | handle | D1 | first direction |
| D2 | second direction | | | | |

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An embodiment of the present application is directed to providing a handle locking device capable of preventing a mistaken operation. An embodiment of the present application is also intended to provide a circuit breaker adopting the handle locking device.

An embodiment of the present invention is directed to: a handle locking device, comprising a first frame, a first hook and a second frame, wherein a second hook is provided on the first frame; the first hook is rotatably installed on the first frame; and the second frame is rotatably installed on the first frame and is capable of fixing the first hook and the first frame.

Furthermore, in an embodiment, the second hook may be formed by extending from the first frame, or may be fixed on the first frame.

Furthermore, in an embodiment, a first plane, where a trajectory of the first hook rotating relative to the first frame is located, may be perpendicular to a second plane in which a trajectory of the second frame rotating relative to the first frame is located.

Furthermore, in an embodiment, the first frame comprises a first beam, a second beam, a first side plate and a second side plate, wherein the first beam and the second beam are arranged with an interval therebetween; the first side plate is arranged on a first side of the first beam and the second beam; the second hook is arranged on the first side plate; the second side plate is arranged on a second side of the first beam and the second beam, and the second side and the first side are two opposite sides of the first frame; and the first hook is rotatably installed on the second side plate.

Furthermore, in an embodiment, the handle locking device also comprises a pivot shaft, wherein a first end of the first hook is rotatably installed on the second side plate through the pivot shaft; a clamping jaw is provided on the first hook; and the clamping jaw is formed at a second end of the first hook, and the second end and the first end are two opposite sides of the first hook.

Furthermore, in an embodiment, at least one locating structure is also provided on the first hook, wherein at least one fixing hole is provided on the second side plate; and the first hook and the first frame are preliminarily fixed through the mutual mating between the locating structure and the fixing hole.

Furthermore, in an embodiment, the pivot shaft is parallel to the second side plate.

Furthermore, in an embodiment, a clamping jaw is provided on the first hook, wherein the clamping jaw and the second hook each comprise a first male tab and a second male tab which is arranged at an interval with respect to the first male tab, and the first male tab and the second male tab are different in size.

Furthermore, in an embodiment, the first male tab and the second male tab are different in width.

Furthermore, in an embodiment, the handle locking device comprises a shift lever, wherein the shift lever is arranged between the first side plate and the second side plate and is adjacent to the second beam.

Furthermore, in an embodiment, the second frame comprises a base plate, a first side part, a second side part and two connection parts, wherein the first side part is arranged on one side of the base plate and is adjacent to the second side plate; the second side part is arranged on the other side of the base plate and is arranged opposite to the first side part; the second side part is adjacent to the first side plate; the two connection parts are respectively formed on the first side part and the second side part and are rotatably installed on the first frame respectively through a pivot shaft; and the installation positions of the two connection parts on the first frame are adjacent to the first beam.

An embodiment of the present invention also provides a circuit breaker which comprises a case and a handle installed in the case, wherein a first installation part and a second installation part are arranged on the case; the circuit breaker further comprises a handle locking device mentioned above; only by means of the mating between the first hook and the first installation part and the mating between the second hook and the second installation part can the handle locking device be installed on the case; and the handle can be locked by the second frame of the handle locking device.

Furthermore, in an embodiment, the first installation part and the second installation part each comprise a first installation hole and a second installation hole, wherein the first installation hole and the second installation hole are different in size.

The handle locking device in one embodiment of the present invention and the handle locking device in an embodiment of the circuit breaker adopting the handle locking device can be installed on the circuit breaker only by means of the mating between the first hook and the first installation part and the mating between the second hook and the second installation part, so that it can prevent an operator from unintentionally setting an "OFF" position of the handle locking device in an "ON" position of the circuit breaker during installation, and thus the safety of the operator can be guaranteed in power-on and power-off situations or during maintenance, thereby improving the safety of personnel. In addition, the first hook is rotatably installed on the first frame, so that the handle locking device can be conveniently and rapidly installed on the circuit breaker or demounted from the circuit breaker.

FIG. 1 is a structural schematic diagram of a handle locking device 100 in one embodiment of the present invention. As shown in FIG. 1, the handle locking device 100 comprises a first frame 110, a first hook 120, a second frame 130 and a shift lever 140. The first hook 120 is rotatably installed on the first frame 110 and can be used for installing the first frame 110 in a circuit breaker adopting the handle locking device 100; the second frame 130 is rotatably installed on the first frame 110, and can fix the first hook 120 and the first frame 110 relative to each other and lock the handle of the circuit breaker; the shift lever 140 is installed on the first frame 110 for preventing the handle locking device 100 from locking the handle of the circuit breaker in the "ON" position of the circuit breaker; and when the shift lever 140 is cut off or removed, the handle locking device 100 can lock the handle in the "ON" position of the circuit breaker.

Figure 2:
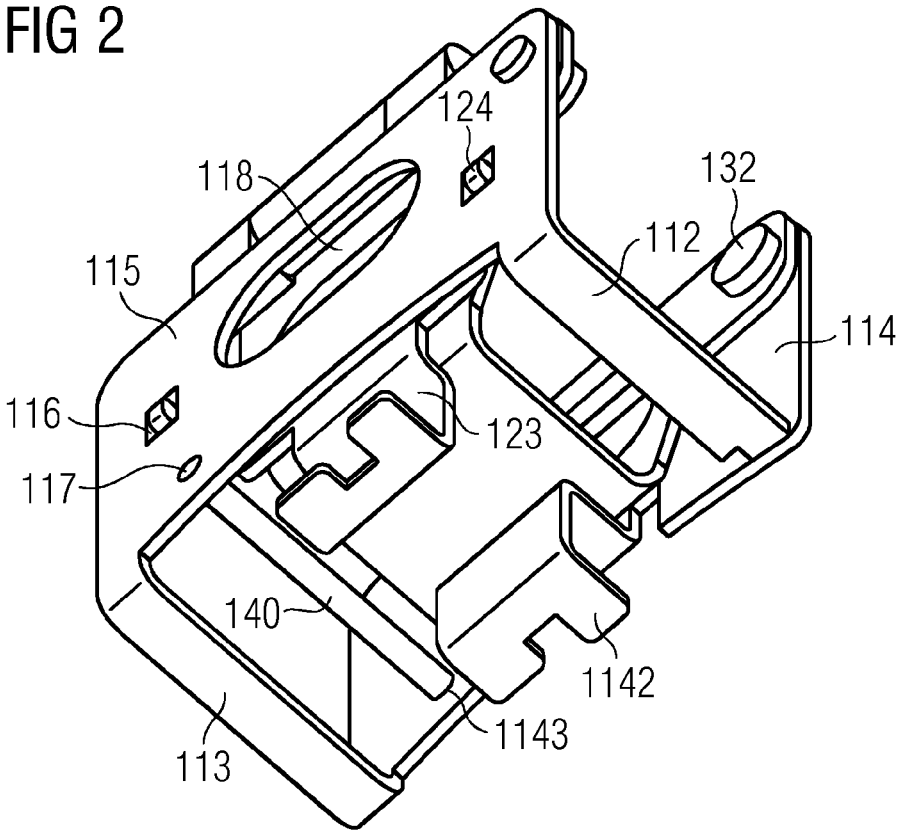
FIG. 2 is a schematic diagram of the bottom of the handle locking device in FIG. 1.

Specifically, as shown in FIGS. 1 and 2, the first frame 110 comprises a first beam 112, a second beam 113, a first side plate 114 and a second side plate 115.

The first beam 112 and the second beam 113 are arranged with an interval therebetween and are substantially parallel to each other. Identifications can be respectively set for the first beam 112 and the second beam 113 to indicate the operating state of the handle locking device 100, for example, an "OFF" can be set on the first beam 112.

The first side plate 114 is arranged on a first side of the first beam 112 and the second beam 113, such as the right side (when the first frame 110 is at the position shown in FIG. 2), and is respectively connected to the end parts of the first beam 112 and the second beam 113. In one embodiment, the first side plate 114 is substantially perpendicularly arranged on the first beam 112 and the second beam 113. A second hook 1142 is arranged on the first side plate 114 for mating with a jack socket in the circuit breaker adopting the handle locking device 100 so as to install the first frame 110 in the circuit breaker adopting the handle locking device 100. In one embodiment, the second hook 1142 is arranged on the first side plate 114 and is located between the first beam 112 and the second beam 113. The second hook 1142 can be formed by extending from the first side plate 114 and can also be fixed on the first side plate 114 through bolts, etc. In addition, an installation hole 1143 can also be arranged on the first side plate 114. The installation hole 1143 is arranged close to the second beam 113 on the first side plate 114 for installing the shift lever 140. A locking hole 118 is provided on the first side plate 114 for fixing the second frame 130 (further description will be given below).

The second side plate 115 is arranged on a second side of the first beam 112 and the second beam 113, such as the left side (when the first frame 110 is at the position shown in FIG. 2), and is respectively connected to the end parts of the first beam 112 and the second beam 113. In one embodiment, the second side plate 115 is substantially perpendicularly arranged on the first beam 112 and the second beam 113. A locking hole 118, two fixing holes 116 and an installation hole 117 are provided on the second side plate 115. The locking hole 118 is used for fixing the second beam 130 (further description will be given below). Two fixing holes 116 are arranged at an interval on the second side plate 115 and are located at two sides of the locking hole 118, and the two fixing holes 116 can be used for fixing the first hook 120. The installation hole 117 is arranged close to the second beam 113 on the second side plate 115 for installing the shift lever 140.

Figure 3:
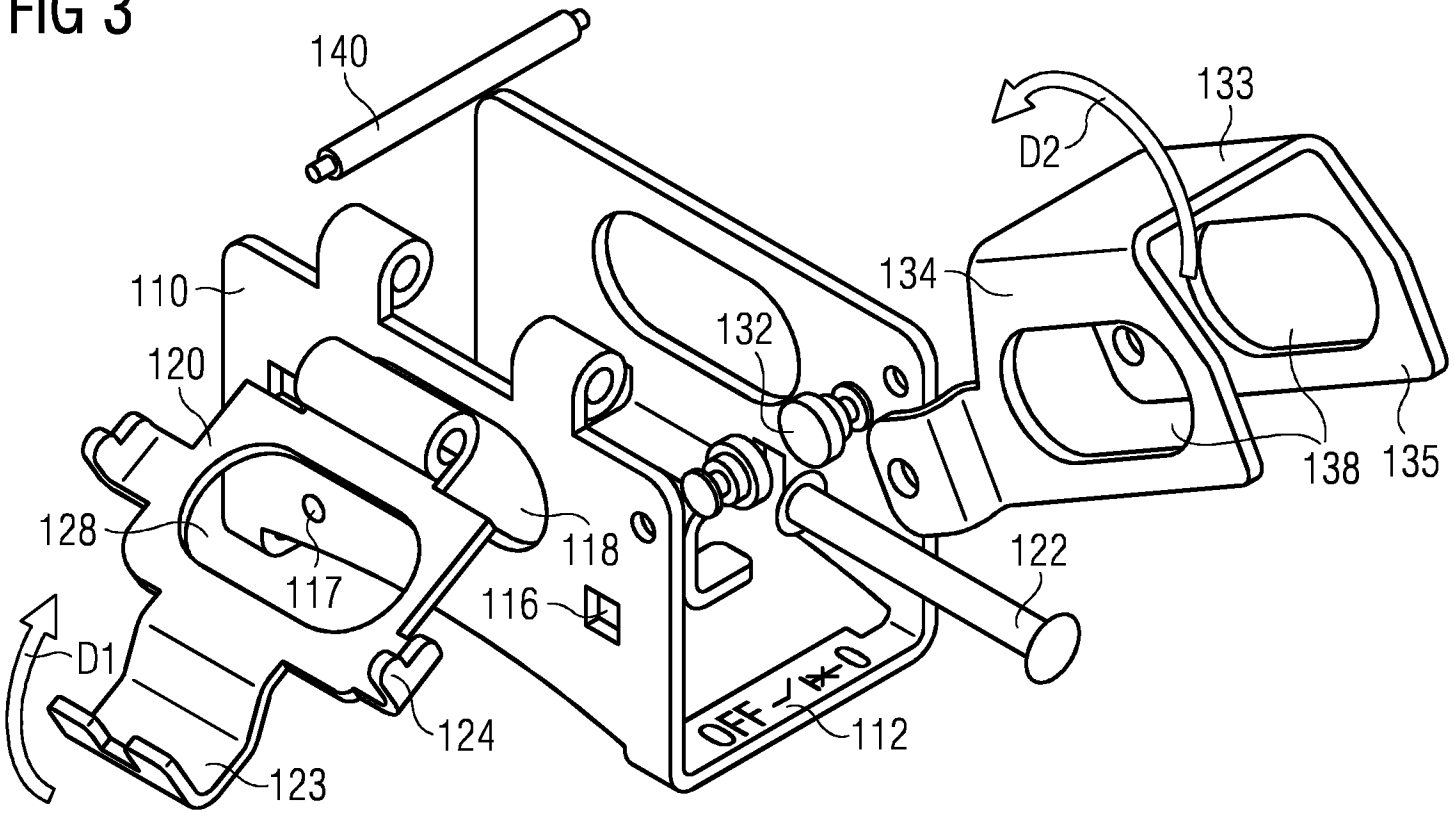
FIG. 3 is an exploded schematic diagram of the handle locking device in FIG. 1.

The first hook 120 is rotatably installed on the first frame 110. As shown in FIG. 3, a first end of the first hook 120 can be rotatably installed on the second side plate 115 through a pivot shaft 122. In one embodiment, the pivot shaft 122 is substantially parallel to the second side plate 115, and the first hook 120 rotates relative to the first frame 110 by taking the pivot shaft 122 as a rotation shaft, for example, rotating along a first direction D1 from the exterior of the first frame 110 to the interior of the first frame 110, or rotating from the interior of the first frame 110 to the exterior of the first frame 110. A clamping jaw 123, a locking hole 128 and two locating structures 124 are also provided on the first hook 120. The clamping jaw 123 is formed at a second end of the first hook 120, and the second end and the first end are two opposite ends on the first hook 120. The locking hole 128 is formed on the first hook 120 and is located between the first end and the second end of the first hook 120. The two fixing holes 116 on the two locating structures 124 and the second side plate 115 are arranged with a one-to-one correspondence: when the first hook 120 rotates to the interior of the first frame 110 and is substantially parallel to the second side plate 115, the two locating structures 124 can be inserted into the two fixing holes 116 and can mutually mate with the two fixing holes 116 so as to preliminarily fix the first hook 120 on the second side plates 115; and meanwhile, the locking hole 128 aligns with the locking hole 118, and the clamping jaw 123 extends from the interior of the first frame 110 to the exterior of the first frame 110 for mating with the jack socket in the circuit breaker adopting the handle locking device 100 so as to install the first frame 110 in the circuit breaker adopting the handle locking device 100.

Figure 7:
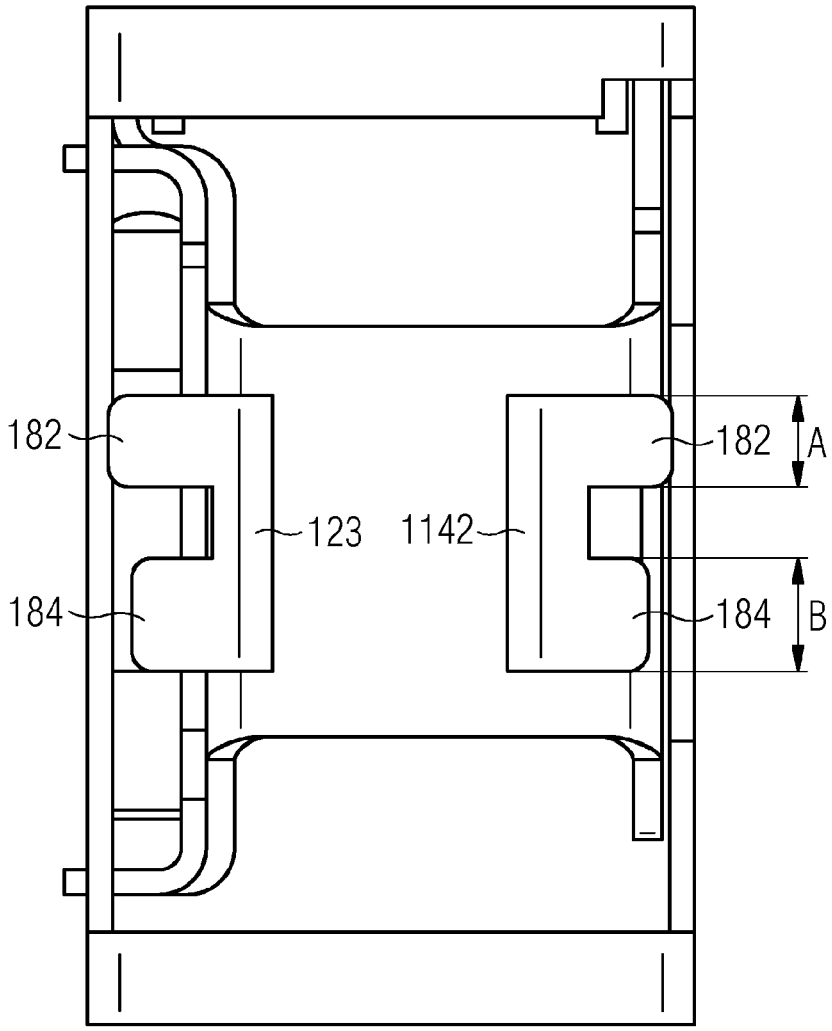
FIG. 7 is a schematic diagram of a clamping jaw and a second hook of the handle locking device in FIG. 1.
Figure 8:
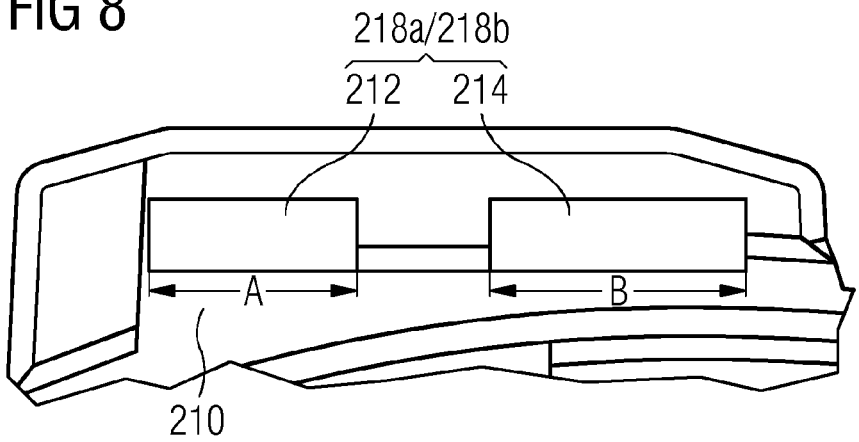
FIG. 8 is a schematic diagram of a first installation hole and a second installation hole on a case of a circuit breaker.

In one embodiment, as shown in FIGS. 7 and 8, the clamping jaw 123 and the second hook 1142 each comprise a first male tab 182 and a second male tab 184. The first male tab 182 and the second male tab 184 are arranged with an interval therebetween, and the first male tab 182 and the second male tab 184 are different in size, such as in terms of width; for example, the width A of the first male tab 182 is less than the width B of the second male tab 184; a straight line where the first male tab 182 on the clamping jaw 123 and the first male tab 182 on the second hook 1142 are located is substantially parallel to a straight line where the second male tab 184 on the clamping jaw 123 and the second male tab 184 on the second hook 1142 are located, that is to say, the first male tab 182 and the second male tab 184 on the clamping jaw 123, and the first male tab 182 and the second male tab 184 on the second hook 1142, are non-centrosymmetrical. A first installation part 218*a* for installing the clamping jaw 123 and a second installation part 218*b* for installing the second hook 1142 are provided on the case 210; and the first installation part 218*a* and the second installation part 218*b* each comprise a first installation hole 212 and a second installation hole 214. The first installation hole 212 is used for installing the first male tab 182, and the second installation hole 214 is used for installing the second male tab 184. The width A of the first installation hole 212 is less than the width B of the second installation hole 214. The handle locking device 100 can be installed on the case 210 through the mating between the first installation hole 212 and the first male tab 182 and the mating between the second installation hole 214 and the second male tab 184. The first male tab 182 and the second male tab 184 on the clamping jaw 123, and the first male tab 182 and the second male tab 184 on the second hook 1142, are non-centrosymmetrical; therefore, when an operator unintentionally sets an "OFF" position of the handle locking device 100 in an "ON" position of the circuit breaker during installation, as the width B of the second male tab 184 is greater than the width A of the first installation hole 212, the second male tab 184 cannot be inserted into the first installation hole 212, and so the safety of the operator can be guaranteed in power-on and power-off situations or during maintenance, thereby improving the safety of personnel. In addition, the first hook 120 and the second hook 1142 can also adopt an asymmetric structure, for example, the first male tab 182 and the second male tab 184 on the clamping jaw 123, and the first male tab 182 and the second male tab 184 on the second hook 1142, are different in width, or the width of one of them is different from the widths of the other three, etc.

The second frame 130 is rotatably installed on the first frame 110, for example, the second frame 130 can rotate along a second direction D2 from the exterior of the first frame 110 to the interior of the first frame 110, or rotate from the interior of the first frame 110 to the exterior of the first frame 110. In one embodiment, the first direction D1 is substantially perpendicular to the second direction D2, and the first plane where the rotating trajectory of the first hook 120 is located is perpendicular to the second plane where the rotating trajectory of the second frame 130 is located. A second frame 130 comprises a base plate 133, a first side part 134, a second side part 135, two connection parts 136 and two locking holes 138. The first side part 134 is arranged on one side of the base plate 133 and is close to the second side plate 115. The second side part 135 is arranged on the other side of the base plate 133 and is arranged opposite to the first side part 134, and the second side part 135 is close to the first side plate 114. The two connection parts 136 are respectively formed on the first side part 134 and the second side part 135 and are rotatably installed on the first frame 110 respectively through a pivot shaft 132. The installation positions of the two connection parts 136 on the first frame 110 are close to the first beam 112. The two locking holes 138 are respectively formed on the first side part 134 and the second side part 135.

One end of the shift lever 140 is installed in the installation hole 117 of the second side plate 115, and the other end of the shift lever 140 is installed in the installation hole 1143 of the first side plate 114. The shift lever 140 can be used for preventing the handle locking device 100 from locking the handle of the circuit breaker in the "ON" position of the circuit breaker; and when the shift lever 140 is cut off or removed, the handle locking device 100 can lock the handle in the "ON" position of the circuit breaker.

The above description is a specific structure of the handle locking device 100 in one embodiment of the present invention, and an application method of applying the device in a circuit breaker will be described briefly.

Figure 4:
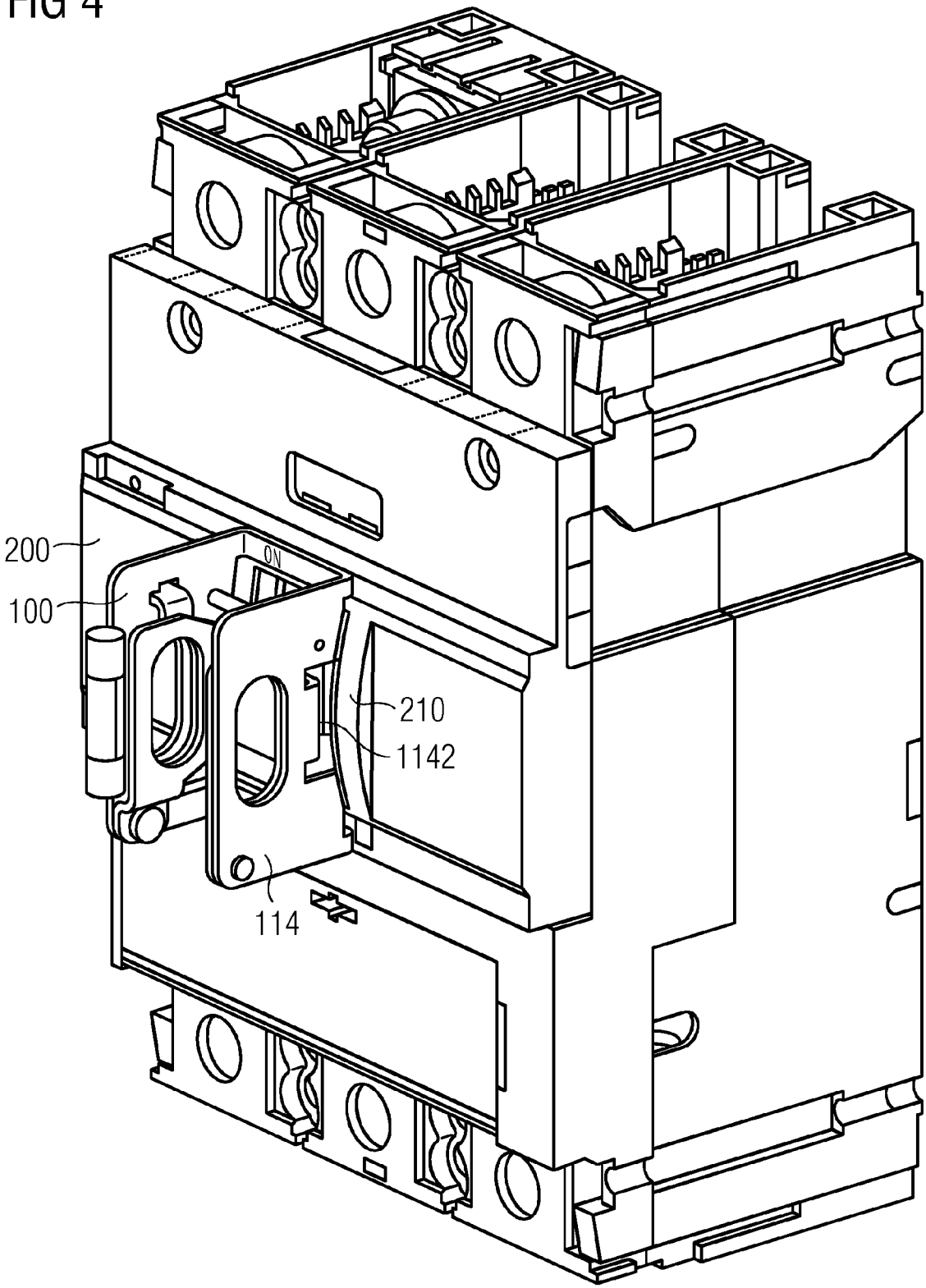
FIG. 4 is a schematic diagram of when the handle locking device in FIG. 1 is used by a circuit breaker.
Figure 5:
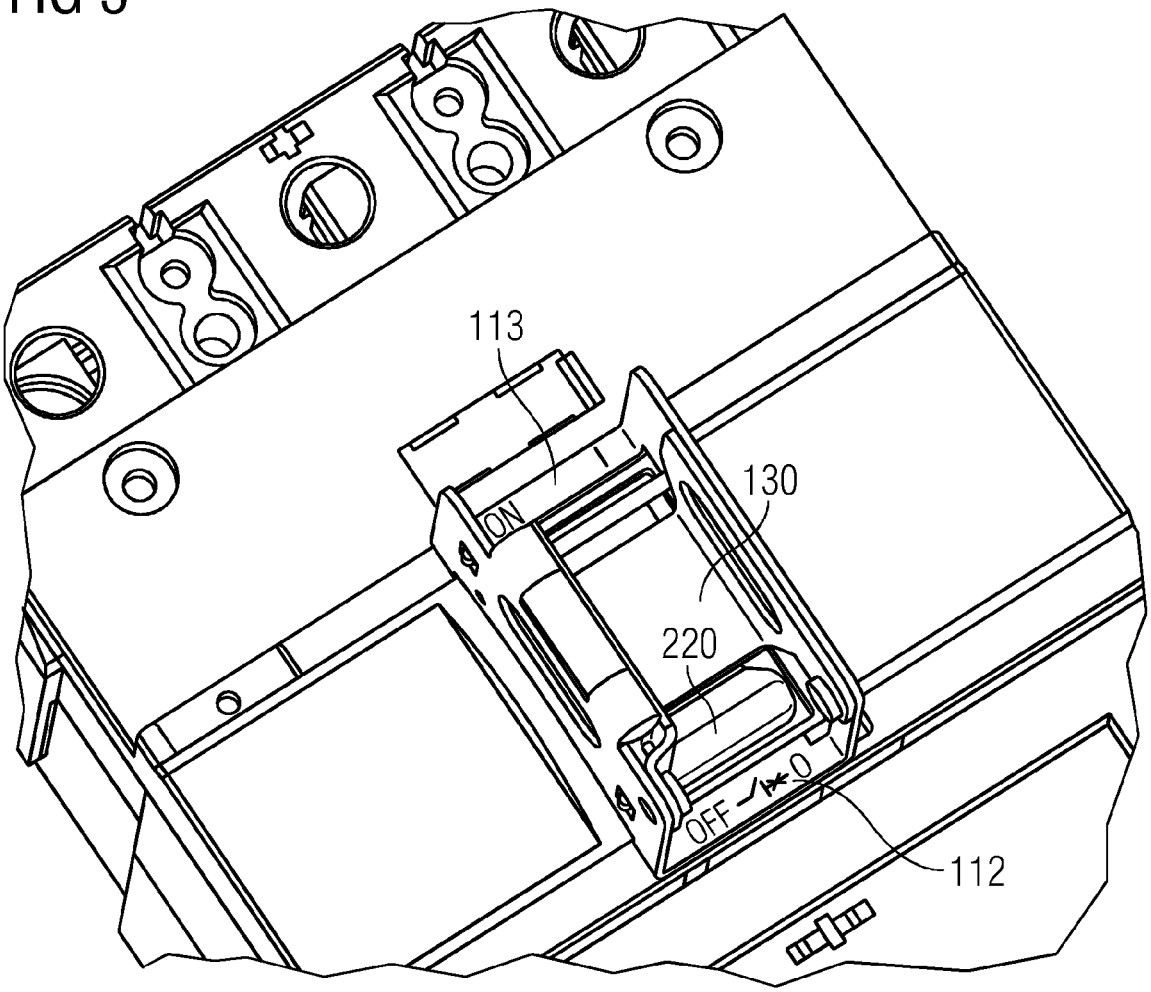
FIG. 5 is a schematic diagram of when a handle of a circuit breaker is locked in an OFF position by the handle locking device in FIG. 1.
Figure 6:
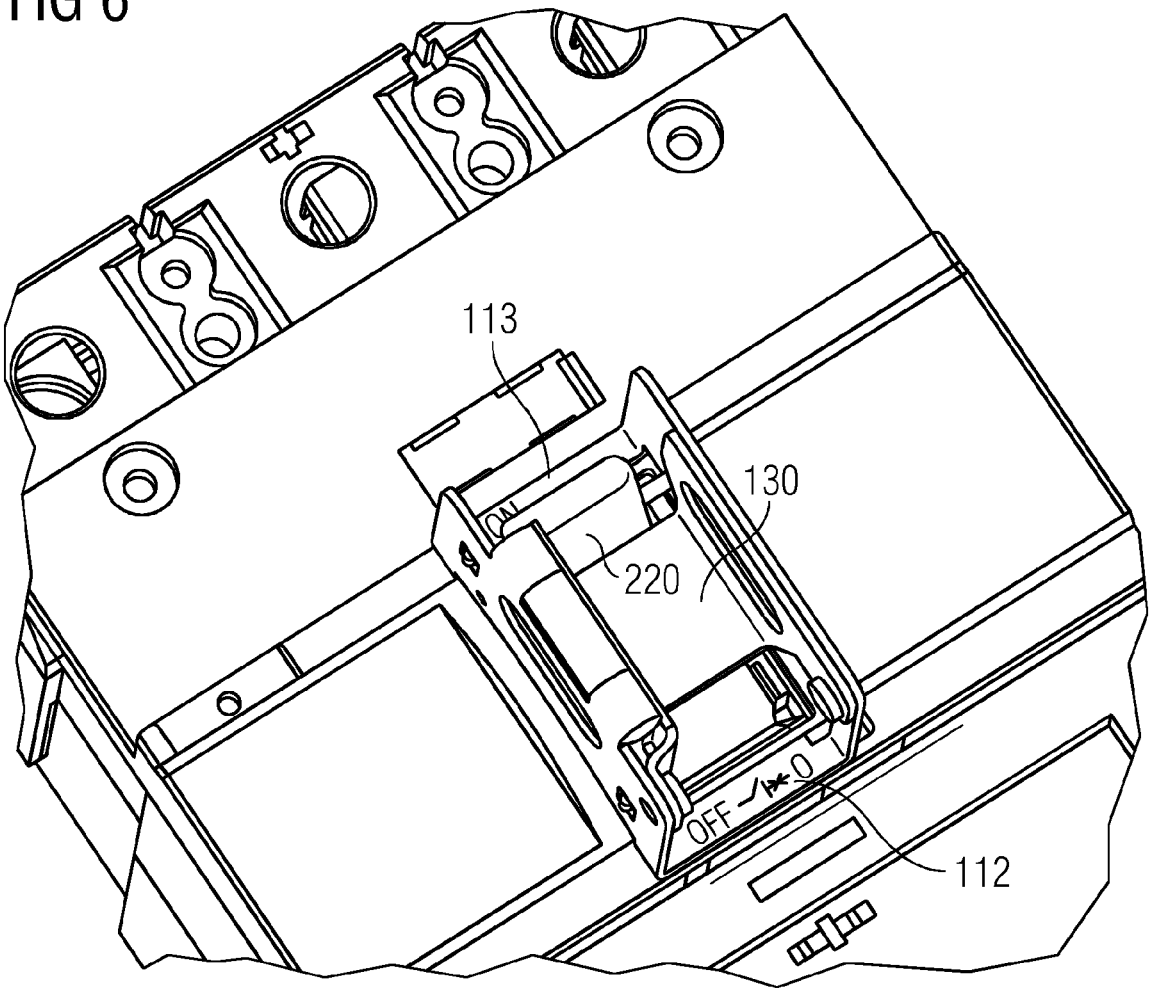
FIG. 6 is a schematic diagram of when a handle of a circuit breaker is locked in an ON position by the handle locking device in FIG. 1.

FIG. 4 is a schematic diagram of when the handle locking device 100 in FIG. 1 is used in a circuit breaker 200. FIG. 5 is a schematic diagram of when a handle 220 of a circuit breaker 200 is locked in an OFF position by the handle locking device 100 in FIG. 1. FIG. 6 is a schematic diagram of when the handle 220 of the circuit breaker 200 is locked in an ON position by the handle locking device 100 in FIG. 1. As shown in FIGS. 4-6, the handle locking device 100 is arranged on the case 210 of the circuit breaker 200, to make the second hook 1142 on the first side plate 114 be inserted into the jack socket on the case 210 of the circuit breaker 200, and to make the handle 220 of the circuit breaker 200 be located between the first beam 112 and the second beam 113; and then the first hook 120 is rotated along the first direction D1 until the two locating structures 124 on the first hook 120 are inserted into the two fixing holes 116 and mate with the two fixing holes 116 so as to preliminarily fix the first hook 120 on the second side plates 115. At this moment, the locking hole 128 aligns with the locking hole 118, and the clamping jaw 123 extends out from the interior of the first frame 110 to the exterior of the first frame 110 and mates with the jack socket on the case 210 of the circuit breaker 200, so that the first frame 110 can be installed on the circuit breaker 200 adopting the handle locking device 100 by means of the mating between the first hook 120, the second hook 1142, and the jack socket in the circuit breaker 200. Then, the second frame 130 is rotated along the second direction D2 until the base plate 133 of the second frame 130 presses against the clamping jaw 123 and the second hook 1142. At this moment, the first side part 134 is adhered to the second side plate 115, and the second side part 135 is adhered to the first side part 134, so that the first hook 120 is fixed on the second side plate 115. At the same time, the locking hole 138, the locking hole 128 and the locking hole 118 align with one another, so that the second frame 130 can be prevented from rotating by inserting a lock catch structure into the locking hole 138, the locking hole 128 and the locking hole 118.

As described above, the first hook 120 and the second hook 1142 are non-symmetrically arranged on the first frame 110 by the handle locking device 100 in one embodiment of the present invention and the handle locking device 100 in the circuit breaker adopting the handle locking device 100, so that it can prevent an operator from unintentionally setting an "OFF" position of the handle locking device 100 in an "ON" position of the circuit breaker during installation, and thus the safety of the operator can be guaranteed in power-on and power-off situations or during maintenance, thereby improving the safety of personnel. In addition, the first hook 120 is rotatably installed on the second side plate 115, so that the handle locking device 100 can be conveniently and rapidly installed on the circuit breaker or demounted from the circuit breaker.

In conclusion, an embodiment of the present invention discloses a handle locking device which comprises a first frame, a first hook and a second frame, wherein a second hook is provided on the first frame; the first hook is rotatably installed on the first frame; and the second frame is rotatably installed on the first frame and is capable of fixing the first hook and the first frame. Since the handle locking device can be installed on a circuit breaker only through the mating between the first hook and the first installation part of the circuit breaker and the mating between the second hook and the second installation part of the circuit breaker, it can prevent an operator from unintentionally setting an "OFF" position of the handle locking device in an "ON" position of the circuit breaker during installation, so that the safety of the operator can be guaranteed in power-on and power-off situations or during maintenance, thereby improving the safety of personnel. In addition, the first hook is rotatably installed on the first frame, so that the handle locking device can be conveniently and rapidly installed on the circuit breaker or demounted from the circuit breaker.

Mentioned above are merely preferred example embodiments of the present invention, which are not intended to limit the present invention; and any modifications, equivalent replacements, improvements, etc. made within the spirit and principles of the present invention shall be covered in the protection scope of the present invention.

What is claimed is:

1. A handle locking device, comprising:

a first frame;

a first hook;

a second frame; and a second hook provided on the first frame, the first hook being rotatably installed on the first frame and the second frame being rotatably installed on the first frame and being capable of fixing the first hook and the first frame, wherein a first plane, where a trajectory of the first hook rotating relative to the first frame is located, is perpendicular to a second plane where a trajectory of the second frame rotating relative to the first frame is located.

2. The handle locking device of claim 1, further comprising:

a clamping jaw, provided on the first hook, the clamping jaw and the second hook each comprising a first male tab and a second male tab, arranged at an interval with respect to the first male tab, the first male tab and the second male tab being different in size.

3. The handle locking device of claim 2, wherein the first male tab and the second male tab are different in width.

4. A circuit breaker, comprising:

a case; and a handle installed in the case, wherein a first installation part and a second installation part are arranged on the case;

the handle locking device of claim 1, only by way of the mating between the first hook and the first installation part and the mating between the second hook and the second installation part is the handle locking device installable on the case, wherein the handle is lockable by the second frame of the handle locking device.

5. The circuit breaker of claim 4, wherein the first installation part and the second installation part each comprise a first installation hole and a second installation hole, and wherein the first installation hole and the second installation hole are different in size.

6. The handle locking device of claim 1, wherein the second hook is either formed by extending from the first frame or fixed on the first frame.

7. A circuit breaker, comprising:

a case; and a handle installed in the case, wherein a first installation part and a second installation part are arranged on the case;

the handle locking device of claim 6, only by way of the mating between the first hook and the first installation part and the mating between the second hook and the second installation part is the handle locking device installable on the case, wherein the handle is lockable by the second frame of the handle locking device.

8. The circuit breaker of claim 7, wherein the first installation part and the second installation part each comprise a first installation hole and a second installation hole, and wherein the first installation hole and the second installation hole are different in size.

9. The handle locking device of claim 1, wherein the first frame comprises:

a first beam, a second beam, a first side plate, and a second side plate, wherein the first beam and the second beam are arranged with an interval therebetween, wherein the first side plate is arranged on a first side of the first beam and the second beam, wherein the second hook is arranged on the first side plate, wherein the second side plate is arranged on a second side of the first beam and the second beam, wherein the second side and the first side are two opposite sides of the first frame, and wherein the first hook is rotatably installed on the second side plate.

10. The handle locking device of claim 9, further comprising:

a shift lever, the shift lever being arranged between the first side plate and the second side plate and being adjacent to the second beam.

11. The handle locking device of claim 9, wherein the second frame comprises a base plate, a first side part, a second side part and two connection parts, wherein the first side part is arranged on one side of the base plate and is adjacent to the second side plate, wherein the second side part is arranged on the other side of the base plate and is arranged opposite to the first side part, wherein the second side part is adjacent to the first side plate, wherein the two connection parts are respectively formed on the first side part and the second side part and are rotatably installed on the first frame respectively through a pivot shaft, and wherein the installation positions of the two connection parts on the first frame are adjacent to the first beam.

12. A circuit breaker, comprising:

a case; and a handle installed in the case, wherein a first installation part and a second installation part are arranged on the case;

the handle locking device of claim 9, only by way of the mating between the first hook and the first installation part and the mating between the second hook and the second installation part is the handle locking device installable on the case, wherein the handle is lockable by the second frame of the handle locking device.

13. The circuit breaker of claim 12, wherein the first installation part and the second installation part each comprise a first installation hole and a second installation hole, and wherein the first installation hole and the second installation hole are different in size.

14. The handle locking device of claim 9, further comprising:

a pivot shaft, a first end of the first hook being rotatably installed on the second side plate through the pivot shaft; and a clamping jaw, provided on the first hook, the clamping jaw being formed at a second end of the first hook, and the second end and the first end being two opposite sides on the first hook.

15. The handle locking device of claim 14, further comprising:

at least one locating structure, provided on the first hook;

at least one fixing hole, provided on the second side plate, wherein the first hook and the first frame are preliminarily fixed through mutual mating between the locating structure and the fixing hole.

16. The handle locking device of claim 14, wherein the pivot shaft is parallel to the second side plate.

* * * * *